United States Patent [19]

Valerio, Jr.

[11] 4,444,290

[45] Apr. 24, 1984

[54] RESCUE APPARATUS

[76] Inventor: Joseph F. Valerio, Jr., 118 W. Sixth St., Bridgeport, Pa. 19405

[21] Appl. No.: 315,955

[22] Filed: Oct. 28, 1981

[51] Int. Cl.[3] ..... A62B 1/20

[52] U.S. Cl. ..... 182/48; 182/82; 193/25 B; 52/2

[58] Field of Search ..... 182/48, 49, 82; 52/2; 193/25 B

[56] References Cited

U.S. PATENT DOCUMENTS

| | | | |
|---|---|---|---|
| 1,265,165 | 5/1918 | Bartley | 182/48 |
| 2,450,595 | 10/1948 | Jones | 182/138 |
| 3,805,916 | 4/1974 | Milam | 182/138 |

FOREIGN PATENT DOCUMENTS

| | | | |
|---|---|---|---|
| 2032366 | 5/1980 | United Kingdom | 182/48 |

*Primary Examiner*—R. P. Machado

*Attorney, Agent, or Firm*—Z. T. Wobensmith, III

[57] ABSTRACT

Rescue apparatus is described for use in the rescue of persons from high rise and other buildings which includes an inflatable funnel of fabric carried by a bracket which is secured to an interior portion of a building, the funnel preferably being located below a window from which an escape is to be made, the funnel having a chute or conduit connected to its lower end through which the person jumping into the funnel slides to and through a window located below the funnel.

6 Claims, 4 Drawing Figures

RESCUE APPARATUS

BACKGROUND OF THE INVENTION

1. Field of the Invention

This invention relates to rescue apparatus and more particularly to an inflatable funnel of fabric having a conduit connected to its lower end through which a person can slide to and through a window opening located below the funnel.

2. Description of the Prior Art

An increasing number of high rise buildings for office and residential use are now in use and rescue apparatus for use with such buildings has not been adequately developed. Small portable rescue apparatus is desirable in the event of fire or other catastrophe.

James, in U.S. Pat. No. 2,450,595 shows a net permanently mounted to and carried by girders on each end of a building, the net being movable on rods across the outer face of the building for use when desired.

Milam, in U.S. Pat. No. 3,805,916, shows escape apparatus which includes a foldable net which extends out a window to catch a person falling from above. Milam requires a person to sit inside a window to counterbalance the net, and would impart a violent upward impact to the person inside.

The present invention lacks the shortcomings of the devices heretofore available, can be readily moved to the place of use, and does not present any mental or physical hazards to the person to be rescued.

SUMMARY OF THE INVENTION

In accordance with the invention rescue apparatus for use in high rise buildings is provided which comprises an inflatable funnel of fabric carried by a bracket which is secured to an interior portion of the building for location below a window from which an escape is to be made and into which the person can jump, the funnel having a conduit connected to its lower end through which the person jumping into the funnel slides to and through a window located below the funnel.

It is the principal object of the invention to provide rescue apparatus which is simple in construction, light in weight and which can be readily moved from place to place, as desired.

It is a further object of the invention to provide rescue apparatus which includes an inflatable funnel of fabric into which a person to be rescued can jump.

It is a further object of the invention to provide rescue apparatus which includes an inflatable funnel of fabric which has a conduit connected thereto through which a person jumping into the funnel can slide.

It is a further object of the invention to provide rescue apparatus which does not present to the person to be rescued mental and physical hazards of the character presented by rescue apparatus heretofore available.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
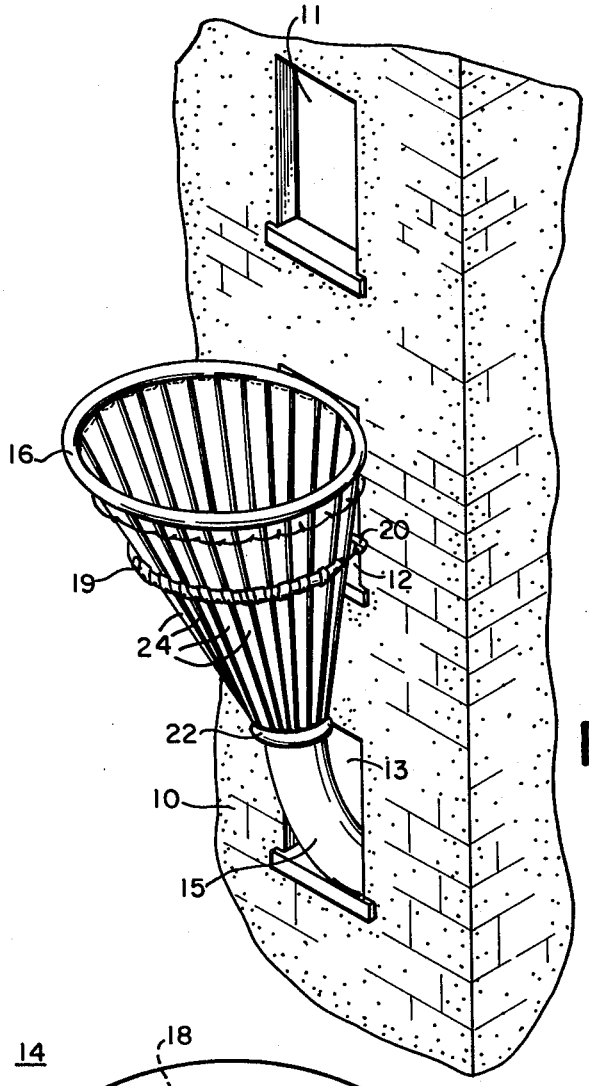
FIG. 1 shows the rescue apparatus of the invention installed on a building.
Figure 2:
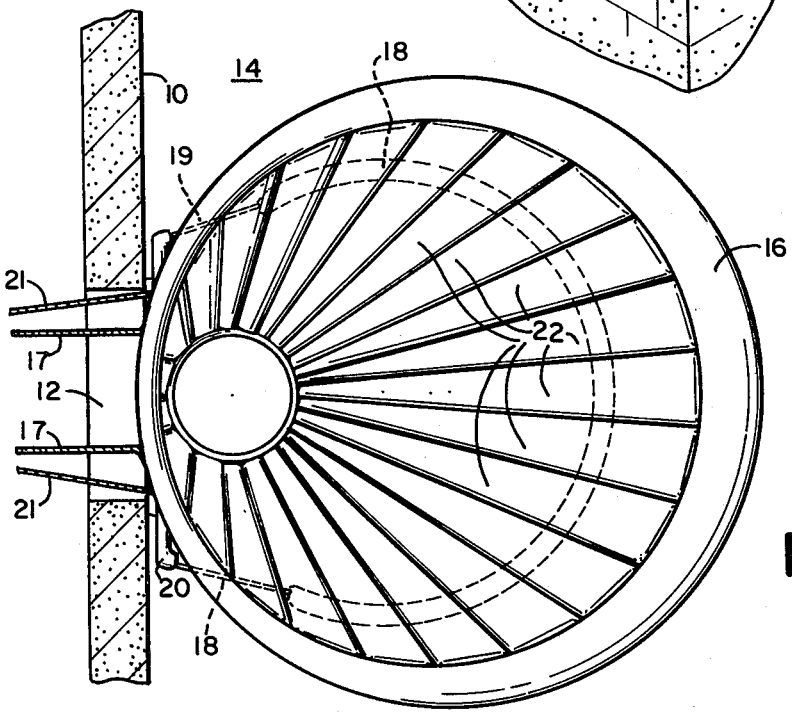
FIG. 2 is a top plan view of the rescue apparatus in accordance with the invention.
Figure 3:
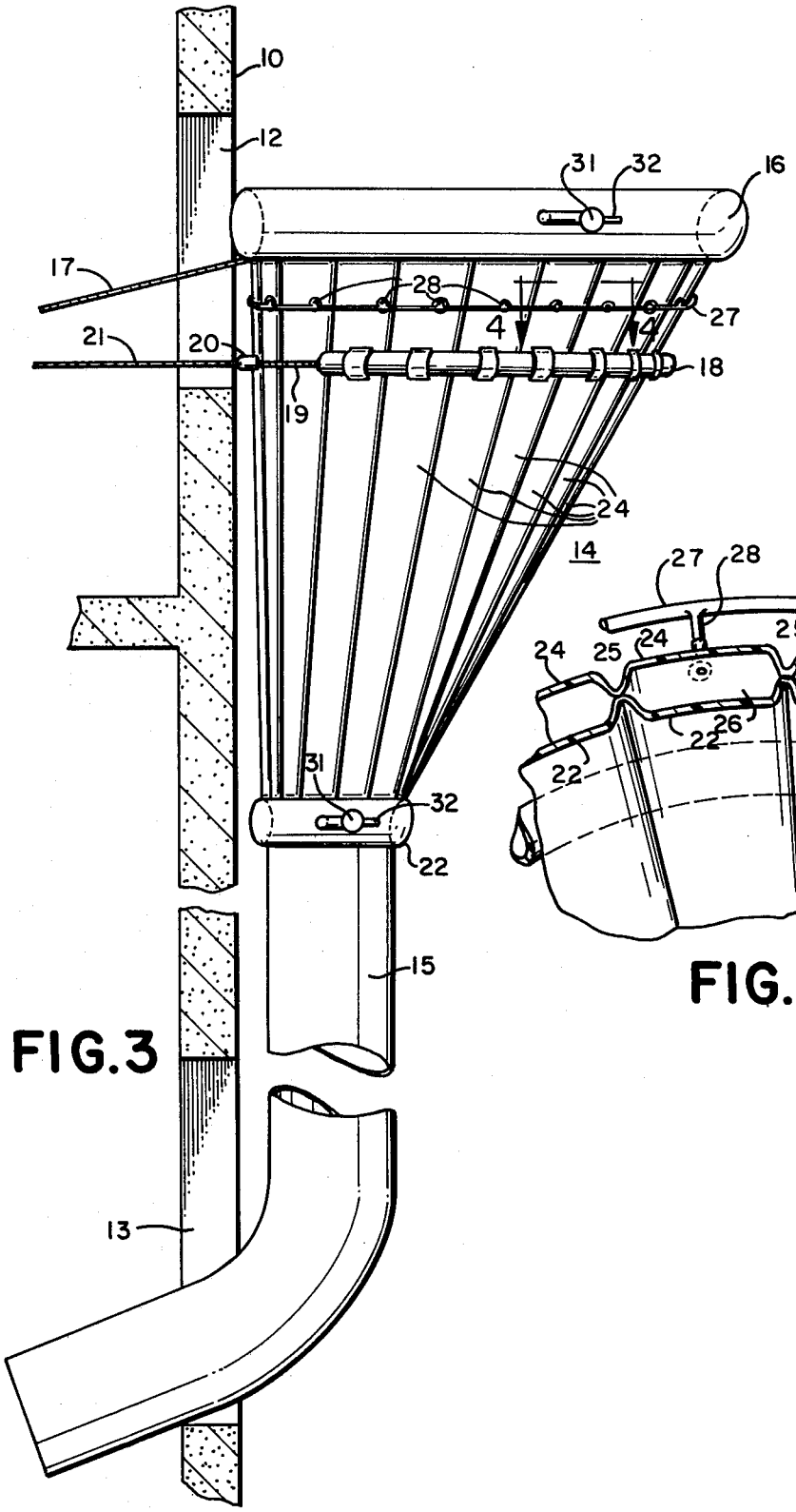
FIG. 3 is a side elevational view of the rescue apparatus in place for use.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings the rescue apparatus is shown in place on a building having a front wall 10 with window openings 11, 12 and 13, one above the other.

The rescue apparatus comprises a funnel 14 and an escape chute or conduit 15 attached to the lower end of the funnel 14. The funnel 14 which in a specific embodiment is of a height of eight feet, has a tube 16 at its upper end, of a diameter of about twelve inches, which is preferably inflated or expanded when in use to retain the upper end of the funnel 14 in an open position. The funnel 14 and chute 15 together weight about 65 pounds before inflation. The inside diameter at the upper end in open position is of the order of eight feet.

The escape chute or conduit 15 preferably has an internal diameter of the order of nineteen inches but if persons of larger size are expected to be involved the internal diameter can be made larger.

The tube 16 has, at the location where it is joined to the funnel 14, a strong security line cord 17 for purposes to be explained.

A support tube 18 is provided of a diameter of about four inches, and a strong support and security line 19 is provided, at the location where the tube 18 is attached to the funnel 14. The line 18 is connected at its ends to the ends of a support rod 20 preferably of light weight. Spaced lines 21 attached to the rod 20 extend inwardly through the window opening 11 where they are secured interiorly of the building to a rigid object (not shown). The lines 17 are similarly secured.

At the junction of the funnel 14 and the chute 15 a tubular ring 22 is provided which is preferably inflated or expanded when in use to retain the chute 15 in open condition.

Figure 4:
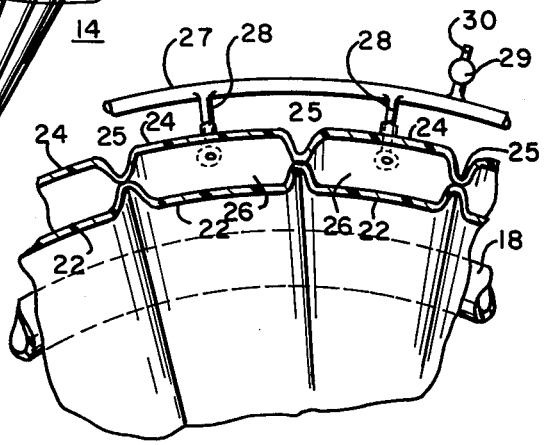
FIG. 4 is a fragmentary sectional view, enlarged, taken approximately on the line 4—4 of FIG. 3.

Referring now to FIG. 4 details of construction of the funnel 14 and air supply are there shown. Inner and outer layers 23 and 24 of fabric are provided with lines of stitching 25 so that tapered air chambers 26 decreasing in size toward the bottom of the funnel 14 are available. In order to provide air for filling the chambers 26 an air hose 27 is provided, connected to the chambers 26 through small pipes 28. A fireman's air pack is connected to the hose 27 through a three way valve 29 and supply connection 30 for connection to the air pack.

Air can also be supplied to the upper tube 16 and ring 22 for inflation thereof through three way valves 31 and air supply pipes 32 for connection to the air pack.

When it is desired to use the rescue apparatus air is supplied to the pipe 27 and through the three way valves 29. Air is also supplied through the three way valves 31 to the upper tube 16 and the ring 22. The lines 17 and 21 are secured to rigid objects inside the building at the window opening desired and the chute 15 inserted in an appropriate window opening.

The rescue apparatus in now ready for use.

The person to be rescued jumps from the window 11 into the funnel 14 which has cushioned walls provided by the tapered air chambers 26 and slides downwardly through the chute 15 into the window opening 13 which is below the window opening 12 at which the funnel 14 is anchored.

After the emergency has passed, the lines 17 and 21 can be removed, the line 19 disconnected from the support tube 18, the air can be discharged from the tapered air chambers 26 by opening the three way valve 29 and from the upper tube 16 and the ring 22 by opening the three way valves 31 so that the funnel 14 and chute 15 can be collapsed and stored.

I claim:

1. Rescue apparatus comprising a funnel adapted to be expanded to an operating condition for reception of a person to be rescued, said funnel at the upper end thereof has a tube around its periphery for expanding the upper end, means for supporting said funnel at the side of a building at a window opening accessible for the person to be rescued, said funnel at the lower end thereof has a ring around its periphery for expanding the lower end, air supply means are provided to provide air to expand said funnel, and said funnel has a delivery chute connected to the lower end thereof in communication with said funnel and extending into a window opening below said first window opening.

2. Rescue apparatus as defined in claim 1 in which said air supply means includes valve members connected to said tube for supplying air to said tube and for discharge of air therefrom.

3. Rescue apparatus as defined in claim 1 in which said air supply means includes valve members connected to said ring for supplying air to said ring and for discharge of air therefrom.

4. Rescue apparatus as defined in claim 1 in which said supporting means comprises a support rod and a cord surrounding a portion of said funnel and connected to said rod.

5. Rescue apparatus as defined in claim 1 in which said funnel has inner and outer walls with stitching to provide vertical air chambers.

6. Rescue apparatus as defined in claim 5 in which valve members are provided connected to said chambers for supplying air to said chambers and for discharge of air therefrom.

* * * * *